US006193356B1

(12) United States Patent
Takata

(10) Patent No.: US 6,193,356 B1
(45) Date of Patent: Feb. 27, 2001

(54) INK JET RECORDING DEVICE CAPABLE OF RELIABLY DISCHARGING AIR BUBBLE DURING PURGING OPERATIONS

(75) Inventor: Masayuki Takata, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/328,413

(22) Filed: Jun. 9, 1999

(30) Foreign Application Priority Data

Jun. 10, 1998 (JP) ..... 10-162607

(51) Int. Cl.[7] ..... B41J 2/165

(52) U.S. Cl. ..... 347/30; 347/92

(58) Field of Search ..... 347/30, 20, 35, 347/92, 85, 65

(56) References Cited

U.S. PATENT DOCUMENTS 6,003,986 * 12/1999 Keefe ..... 347/92

* cited by examiner

*Primary Examiner*—N. Le
*Assistant Examiner*—Shih-Wen Hsieh
(74) *Attorney, Agent, or Firm*—Oliff & Berridge, PLC

(57) ABSTRACT

An ink jet head 31 is formed with two rows of ink ejection channels 33. A manifold 40 is provided for supplying ink from an ink cartridge 50 to the ink jet head 31. The manifold 40 has an ink supply path 43. The ink supply path 43 includes a connection path 44 fluidly connected with the ink cartridge 50 and a broad portion 45 which encompasses ink inlet ports 33*a*. The broad portion 45 broadens from the connection path 44 toward the end of ejection channels 33. A float 46 is provided in the broad portion 45. The float 46 serves as a guide member for guiding ink form the connection path 44 to flow along the inner surface of the broad portion 45 in a rapid speed.

17 Claims, 13 Drawing Sheets

INK JET RECORDING DEVICE CAPABLE OF RELIABLY DISCHARGING AIR BUBBLE DURING PURGING OPERATIONS

BACKGROUND OF THE INVENTION

1. Field of the Invention

The present invention relates to an ink jet recording device having a manifold fluidly connecting an ink cartridge with an ink jet head.

2. Description of the Related Art

A conventional ink jet recording device includes an ink jet head having actuators. The actuators are formed from an electromechanical converting element or electrothermal converting element, and define a plurality of ink chambers aligned in a row. An ink cartridge storing ink is detachably attached to the ink jet head by a manifold. The manifold is formed with an ink supply path that normally broadens from the ink cartridge side to the ink jet head side so as to encompass the entire row of ink chambers. Ink in the ink cartridge is supplied through the ink supply path of the manifold into the ink chambers. When the actuators are energized, ink is ejected from the ink chambers through nozzles to form an image on a recording medium.

Normally, ink stored in the ink cartridge has some air dissolved therein. Also, a certain volume of air is introduced into the ink supply path of the manifold when the ink cartridge is exchanged. The air in the ink supply path can grow into a large air bubble, and obstruct supply of ink into the ink chamber. Also, the air can be drawn into the ink chambers along with ink, thereby blocking the ink chambers. This prevents ink from being ejected from the ink chambers, resulting in defective printing.

In order to overcome these problems, purging operations are performed periodically and also directly after the ink cartridge is exchanged. Specifically, a negative purging pressure is applied to the nozzles of the ink jet head. As a result, fresh ink is supplied from the ink cartridge into the ink supply path and the ink chambers. At the same time, air is sucked out of the ink supply path with some ink.

However, when fresh ink is introduced from the ink cartridge, ink does not easily reach corner portions of the ink supply path, so that the air usually remains at the corner portions. Then, the residual air clings to an inner surface of the ink supply path. When the air floats freely as small air bubbles in the ink supply path, the air bubbles are easily discharged by the purging operations. However, air bubbles that cling to inner surfaces are not sufficiently discharged even during the purging operations. Particularly, the air tends to froth up at locations where the shape of the ink supply path changes. Resultant bubbles cling the side surfaces.

The residual air bubbles which have not been discharged even during purging operations grow into large bubbles, and eventually block the ink chambers. Accordingly, printing will become defective shortly after purging operations. This requires that purging operations be frequently performed during printing. Because purging operations require several minutes to perform, this prevents smooth and quick printing operations.

SUMMARY OF THE INVENTION

It is the objective of the present invention to overcome the above-described problems and also to provide an ink jet recording device with a superior ability to discharge air bubbles that cling to inner surfaces of an ink supply path, and superior ability to introduce fresh ink into the ink supply path during purging operations.

In order to achieve the above and other objectives, there is provided an ink jet recording device including an ink jet head, a manifold, and a guide member. The ink jet head has a surface and is formed with a channel row including a plurality of ink channels. The plurality of ink channels have inlet ports opened at the surface. The manifold is formed with an ink supply path fluidly connecting the plurality of ink channels with a cartridge that stores ink. The ink supply path includes a first portion and a second portion. The second portion is defined by an inner surface. The ink is supplied into the plurality of ink channels from the cartridge through the first portion and the second portion. The guide member is accommodated within the second portion of the ink supply path, and guides the ink within the second portion to flow along the inner surface.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENT

An ink jet recording device 1 according to a preferred embodiment of the present invention will be described while referring to the accompanying drawings. In the following description, the expressions "upper", "lower", "horizontal", and "vertical" are used throughout the description to define the various parts when the ink jet recording device is disposed in an orientation in which it is intended to be used.

Figure 1:
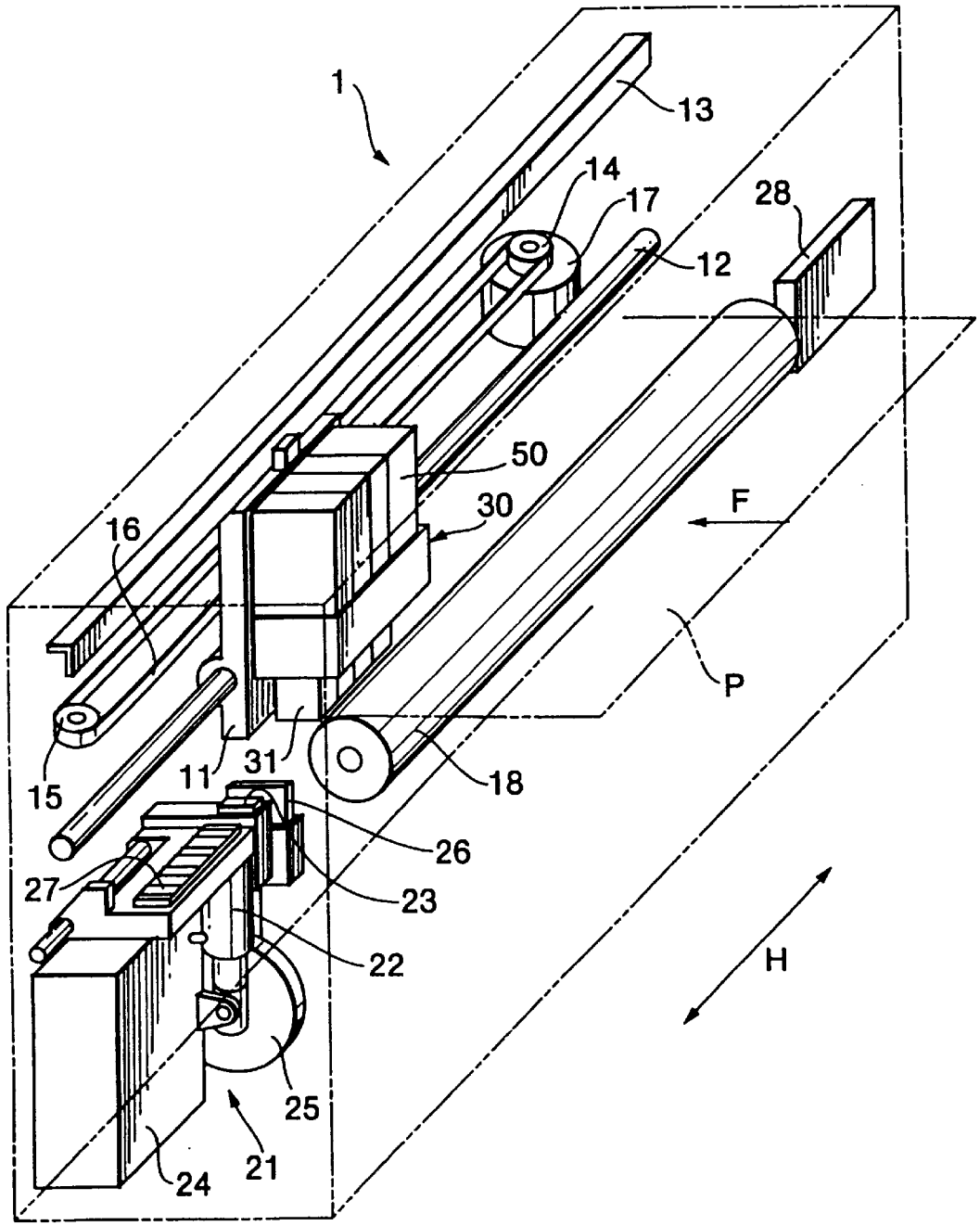
FIG. 1 is a perspective view showing an ink jet recording device according to an embodiment of the present invention.
Figure 2:
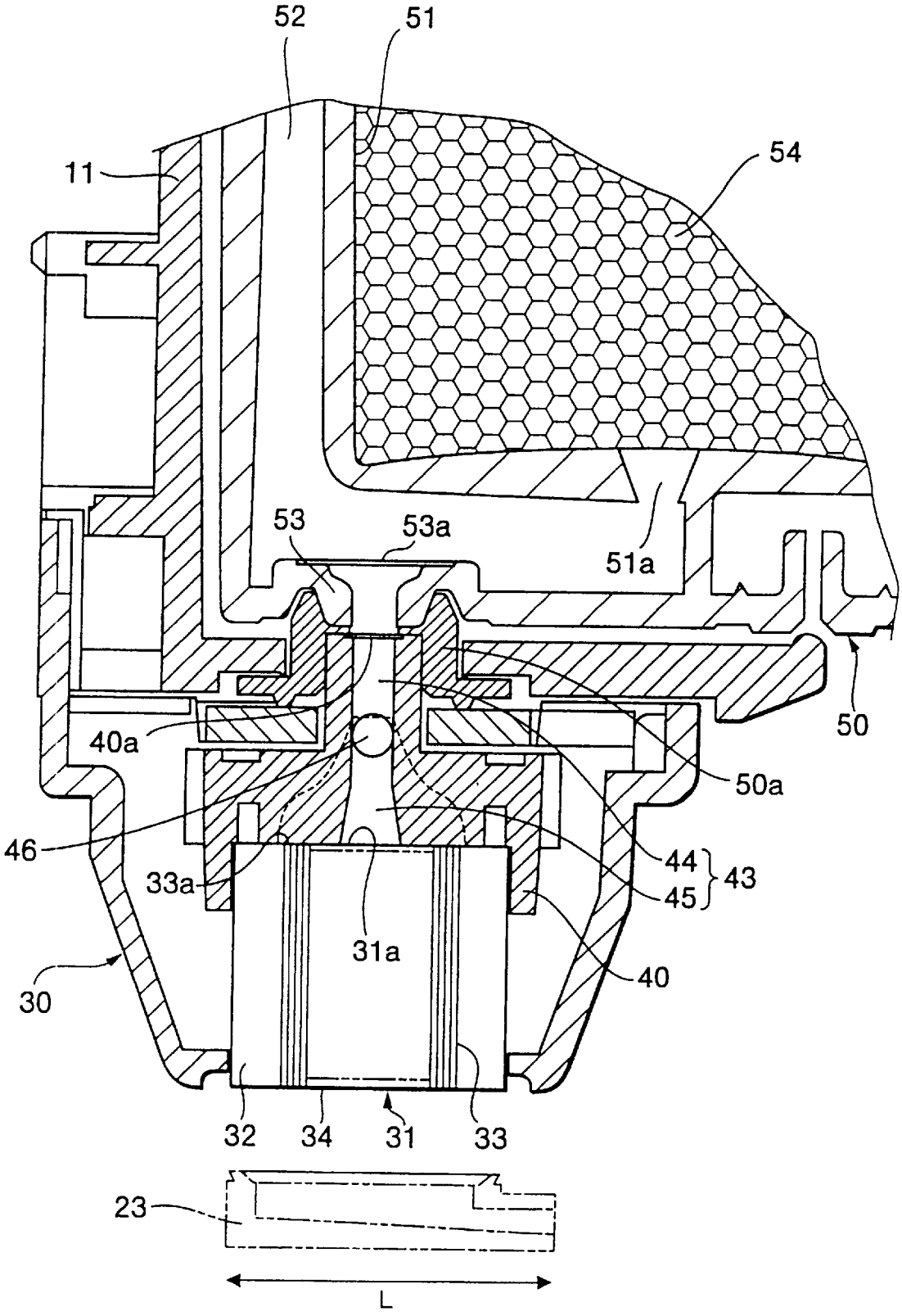
FIG. 2 is a cross-sectional view of partial components of the ink jet recording device of FIG. 1.

As shown in FIG. 1, the ink jet recording device 1 includes a carriage 11, a carriage shaft 12, a guide plate 13, a pair of pulleys 14, 15, a belt 16, a motor 17, a platen roller 18, a head unit 30, and four ink cartridges 50. Each of the ink cartridges 50 stores one of four different colored inks, that is cyan ink, magenta ink, yellow ink, and black ink. The head unit 30 includes four ink jet heads 31 and four manifolds 40 (FIG. 2). The manifolds 40 fluidly connect the ink cartridges 50 with corresponding ink jet heads 31 so that ink is supplied from the ink cartridge 50 to the corresponding ink jet heads 31. The head unit 30 and the ink cartridges 50 are both mounted on the carriage 11.

The carriage shaft 12 and the guide plate 13 are both supported by a frame (not shown) and extend in horizontal directions indicated by an arrow H. The carriage 11 is freely slidably supported on the carriage shaft 12 and the guide plate 13. The belt 16 is wound around and spans between the pair of pulleys 14, 15, and is connected to the carriage 11. When the motor 17 drives the pulley 14, the belt 16 reciprocally moves the carriage 11 along with the head unit 30 and ink cartridge 50 in the horizontal direction H.

The platen roller 18 is freely rotatable and extends in the horizontal direction H below the head unit 30 so as to be in facing confrontation with the lower surfaces of the ink jet heads 31. A print sheet P is fed by a feed mechanism (not shown) in a direction indicated by an arrow F. When the print sheet P is provided between the ink jet heads 31 and the platen roller 18, the ink jet heads 31 selectively eject ink onto the print sheet P to form an image on the print sheet P. The print sheet P formed with the image is, then, discharged out of the ink jet recording device 1.

Figure 3:
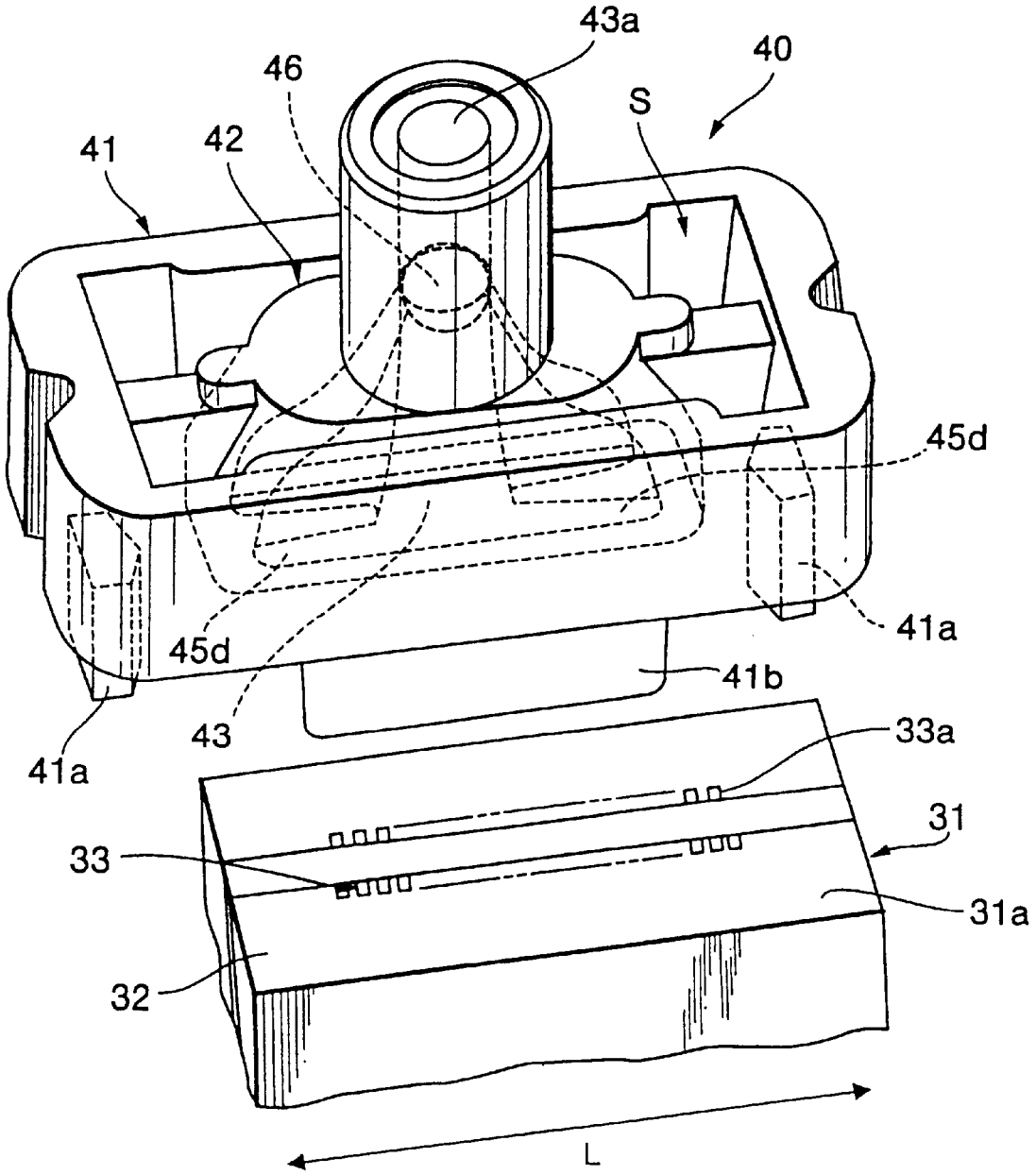
FIG. 3 is an exploded view showing a manifold and an ink jet head of the ink jet recording device of FIG. 1.

Next, detailed description of the ink jet heads 31 will be described. As shown in FIGS. 2 and 3, each ink jet head 31 includes an actuator 32 formed from a piezoelectric ceramic material and a nozzle plate 34 attached to the lower end of the actuator 32. The actuator 32 is formed with two rows of a plurality of ejection channels 33. The rows of ejection channels 33 extend longitudinally along the ink jet head 31 in directions indicated by an arrow L, and each ejection channel 33 extends from the lower end to the upper end of the actuator 32. The nozzle plate 34 is formed with a plurality of nozzles (not shown) in correspondence with the ejection channels 33.

Each ejection channel 33 has an ink inlet port 33*a* opened at an upper surface 31*a* of the ink jet head 31. Ink from the ink cartridge 50 is supplied into the ejection channels 33 through the ink inlet ports 33*a*.

When the actuator 32 is energized to deform during printing operations, the volume of the ejection channel 33 decreases, so that the ink is ejected from the ejection channel 33 through the nozzle, thereby forming an image on the print sheet P. Then, when the actuator 32 returns to its initial condition, the volume of the ejection channel 33 increases to its initial volume, thereby introducing ink from the ink cartridge 50 into the ejection channel 33. It should be noted that the ink jet head 31 can be designed such that ink is introduced into the ejection channel 33 when the actuator 32 deforms, and ink is ejected when the ejection channels 33 returns in its normal condition.

Next, the ink cartridge 50 will be described. As shown in FIG. 2, the ink cartridge 50 includes a joint member 50*a* by which the ink cartridge 50 is freely detachably attached to the upper end of the manifold 40. The ink cartridge 50 is formed with a first ink chamber 51, a second ink chamber 52, a connection hole 51*a*, and ink supply port 53. The first ink chamber 51 houses a porous ink absorption member 54 formed form polyurethane foam, for example. The ink absorption member 54 is impregnated with ink. The connection hole 51*a* fluidly connects the first ink chamber 51 with the second ink chamber 52. Ink impregnating the ink absorption member 54 in the first ink chamber 51 is supplied through the connection hole 51*a*, the second ink chamber 52, and the ink supply port 53 into the manifold 40. A mesh filter 53*a* is provided at the ink supply port 53.

Next, detailed description of the manifold 40 will be described. As shown in FIGS. 2 to 5, the manifold 40 includes a frame 41 and a main portion 42. The frame 41 has a pair of fixing ribs 41*a* and a pair of positioning ribs 41*b*. The pair of fixing ribs 41*a* are fixed to side surfaces of the ink jet head 31 by adhesive. The pair of positioning ribs 41*b* are for positioning the manifold 40 when fixed to the ink jet head 31. The main portion 42 is disposed interior of the frame 41 and partially connected to inner surfaces of the frame 41. A space S is defined between the frame 41 and the main portion 42. When the fixing rib 41*a* is fixed to the side surfaces of the ink jet head 31, adhesive is introduced to fill the space S, so that ink is prevented from leaking from the upper surface 31*a* of the ink jet head 31.

The lower end of the manifold 40 is fixed to the upper surface 31*a* of the ink jet head 31 so as to cover the upper surface 31*a*. The main portion 42 is formed with an ink supply path 43 fluidly connecting the ejection channels 33 with the ink cartridge 50.

As shown in FIG. 1, the ink jet recording device 1 further includes an ink suction unit 21, a wiper unit 26, a protection cap unit 27, and an ink support member 28. The ink suction unit 21, the wiper unit 26, and the protection cap unit 27 are disposed in a reset position of the ink jet heads 31, that is, at a position at the side of the platen roller 18. The ink suction unit 21 is for performing purging operations. The wiper unit 26 is for wiping the nozzle plates 34 of the ink jet heads 31. The protection cap unit 27 is for covering the nozzle plate 34 when printing is not being performed so that ink in the nozzles will not dry out. The ink support member 28 is disposed in a forced ejection position which is at the opposite end of the platen roller 18 from the reset position. The ink support member 28 is for absorbing and maintaining ink that was forcibly ejected from the ink jet heads 31. The forcible ink ejection is performed periodically for preventing the nozzles of the nozzle plate 34 from clogging. The ink suction unit 21, the wiper unit 26, the protection cap unit 27, and the ink support member 28 together configure a recovery maintenance mechanism for recovering and maintaining good ejection condition of the ink jet heads 31.

The ink suction unit 21 includes a suction pump 22, a suction portion 23, a waste ink tank 24, and a cam 25. The suction pump 22 and the suction portion 23 are driven by the drive force transmitted from a drive force transmission mechanism (not shown) and the cam 25. The ink suction unit 21 performs the purging operations regularly or when needed during the printing operations, and also right after the ink cartridge 50 is exchanged so as to introduce fresh ink from a new ink cartridge 50 into the ink supply path 43 and the ejection channels 33.

During the purging operations, the suction portion 23 covers the nozzle plate 34 of the ink jet head 31. In this condition, the suction pump 22 generates a negative purging pressure in the suction portion 23, so that defective ink with air bubbles is sucked out from the ejection channels 33 and the ink supply path 43. As a result, fresh ink is introduced from the ink cartridge 50 into the ink supply path 43 and the ejection channels 33. In this way, the ink jet head 31 becomes ready for printing. The defective ink sucked form the ink jet head 31 in this manner is conveyed to and held in the waste ink tank 24.

Next, detailed description of the ink supply path 43 of the manifold will be described. As shown in FIGS. 2 to 7, the ink supply path 43 includes a connection path 44 having a small diameter and a broad portion 45 connected with the connection path 44. The connection path 44 has an ink inlet 43*a* that is connected to the ink cartridge 50, and is substantially centered between the rows of ejection channels 33. A mesh filter 40*a* is provided at the ink inlet 43*a*.

Figure 5:
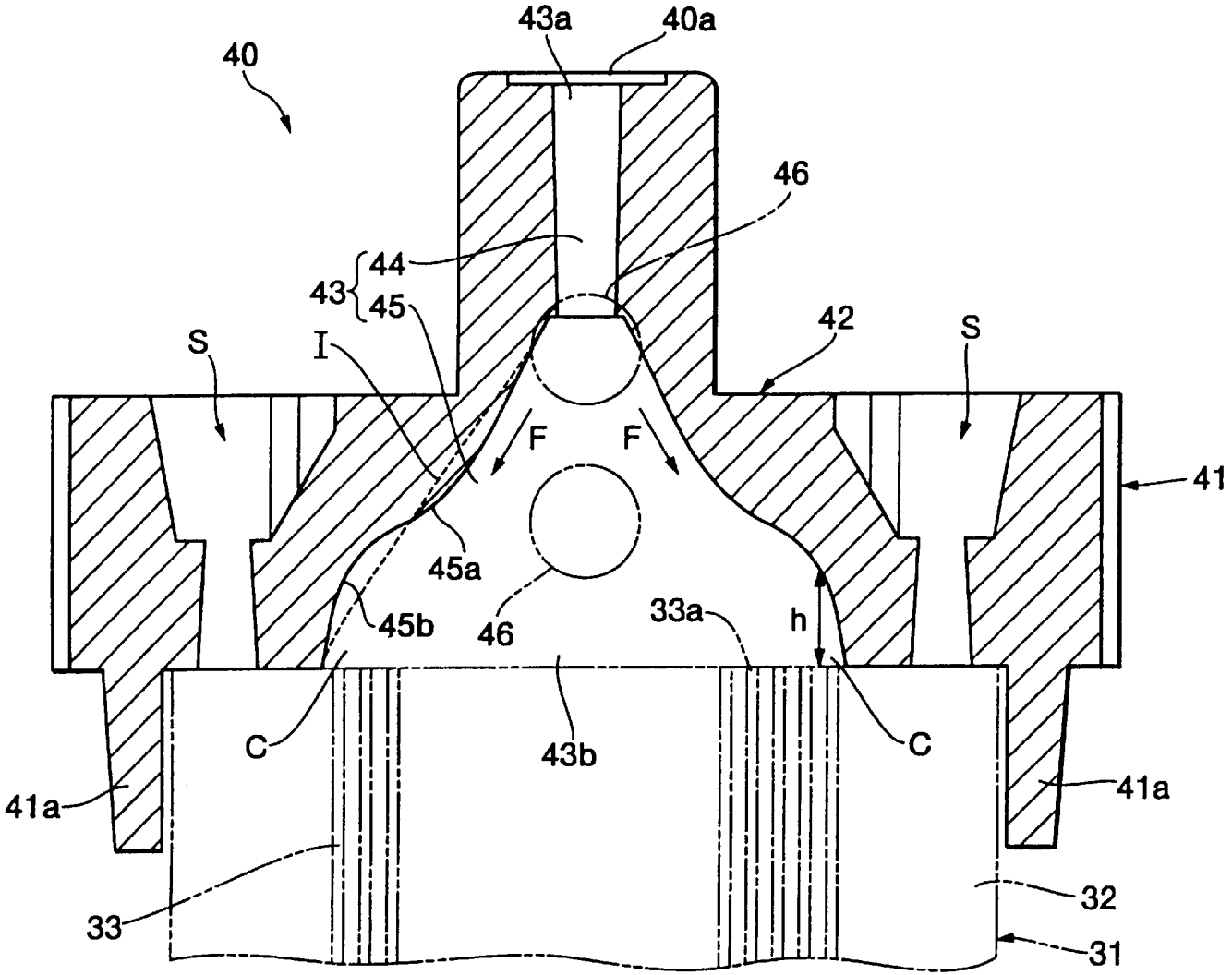
FIG. 5 is a cross-sectional view of the manifold taken along a line V—V of FIG. 4.

As shown in FIG. 5, the broad portion 45 broadens in a substantially symmetrical manner from the connection path 44 toward the ends of the rows of ejection channels 33 in an enlarging tapering manner, and has an ink outlet 43*b* encompassing the ink inlet ports 33*a* of the ejection channels 33. Specifically, the broad portion 45 is defined by an inner surface including a first curved surface 45*a* and a second curved surface 45*b*. The first curved surface 45*a* broadens in a tapering manner from the connection path 44, and protrudes inward toward the interior of the broad portion 45. The second curved surface 45*b* extends in connection with the first curved surface 45*a* toward the end of the row of ejection channels 33, and protrudes away from the interior of the broad portion 45. That is to say, with respect to an imaginary straight line I that connects the connection path 44 with the end of the row of ejection channels 33, the first curved surface 45*a* protrudes interior of the imaginary straight line I, and on the other hand, the second curved surface 45*b* protrudes outward from the imaginary straight line I. The second curved surface 45*b* is a wide incline with respect to the upper surface 31*a* of the ink jet head 31, and defines the corner portion C. In other words, the second curved surface 45*d* extends substantially vertically at a portion adjacent to the upper surface 31*a* of the ink Jet head 31.

A spherical float 46 is disposed within the broad portion 45. The spherical float 46 has a specific gravity smaller than the specific gravity of the ink filling the broad portion 45. The spherical float 46 guides ink introduced from the connection path 44 along the inner surfaces of the broad portion 45.

The float 46 normally floats upward and blocks the connection portion 44. However, the float 46 is drawn downward by flow of ink generated during the purging operations. As a result, the connection path 44 is opened into the fluid communication with the broad portion 45, so that fresh ink is introduced from the connection path 44 into the broad portion 45. It should be noted that the float 46 is also drawn downward by flow of ink during normal printing operations.

Figure 4:
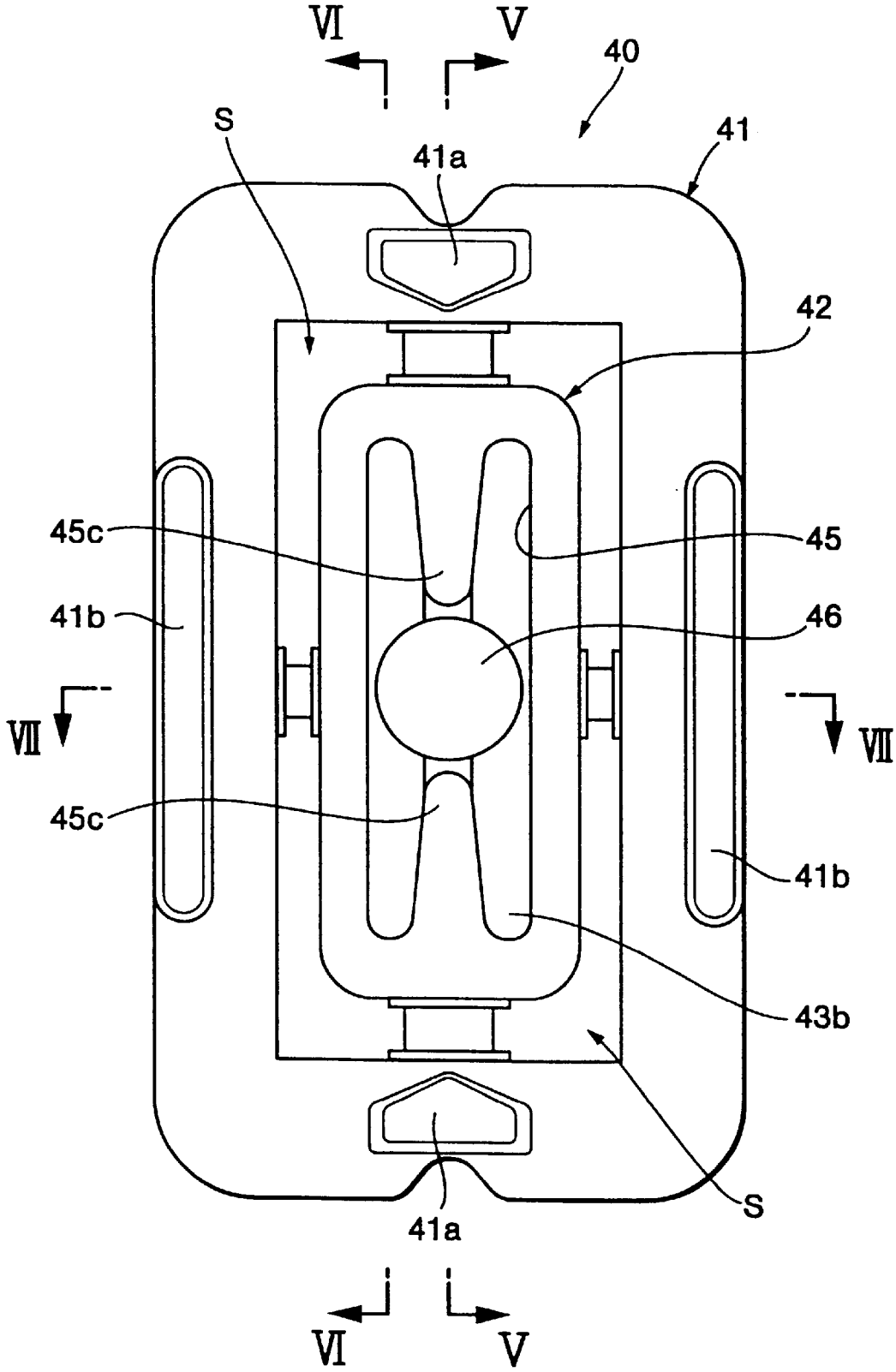
FIG. 4 is a plan view of the manifold.
Figure 6:
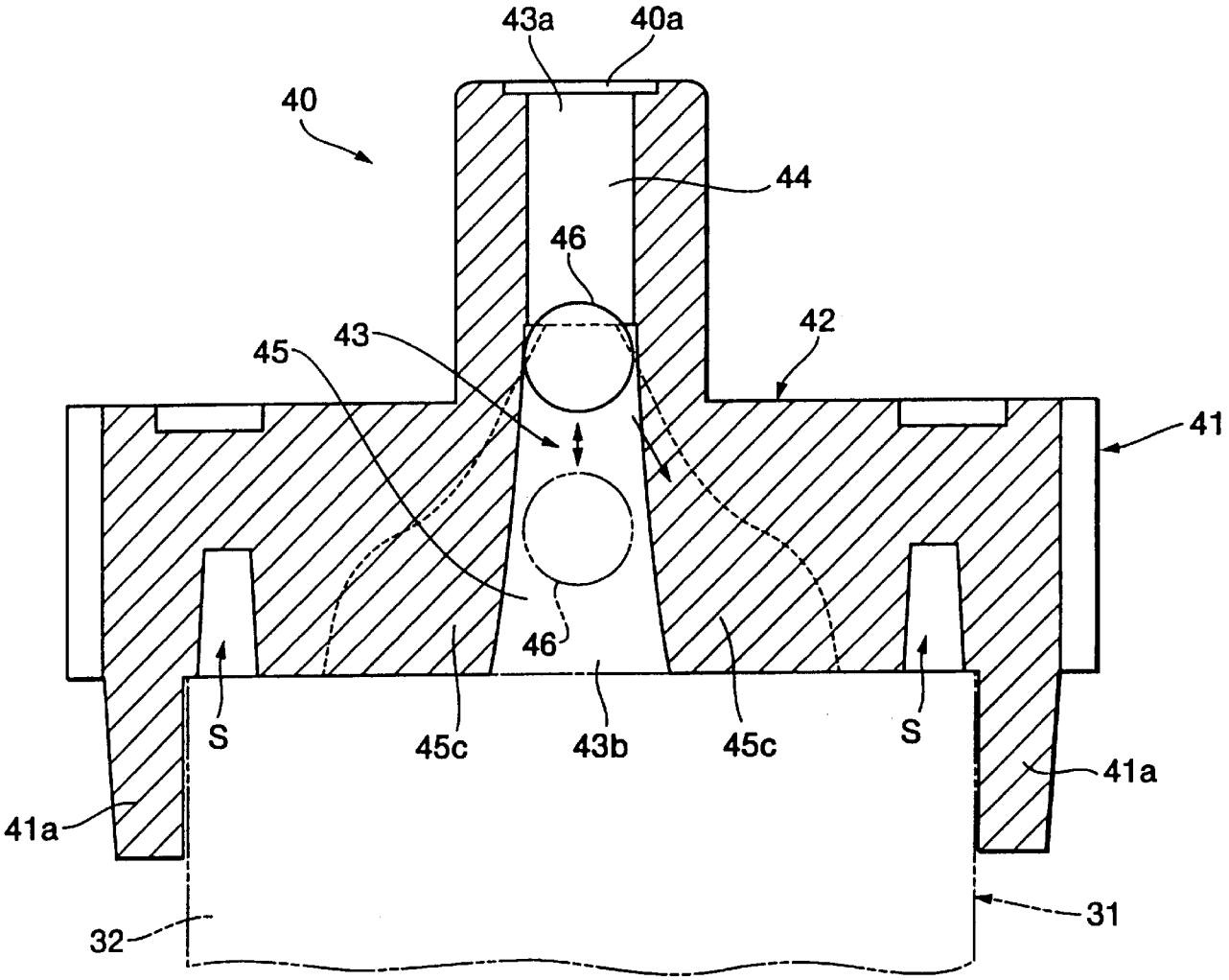
FIG. 6 is a cross-sectional view of the manifold taken along a line VI—VI of FIG. 4.
Figure 7:
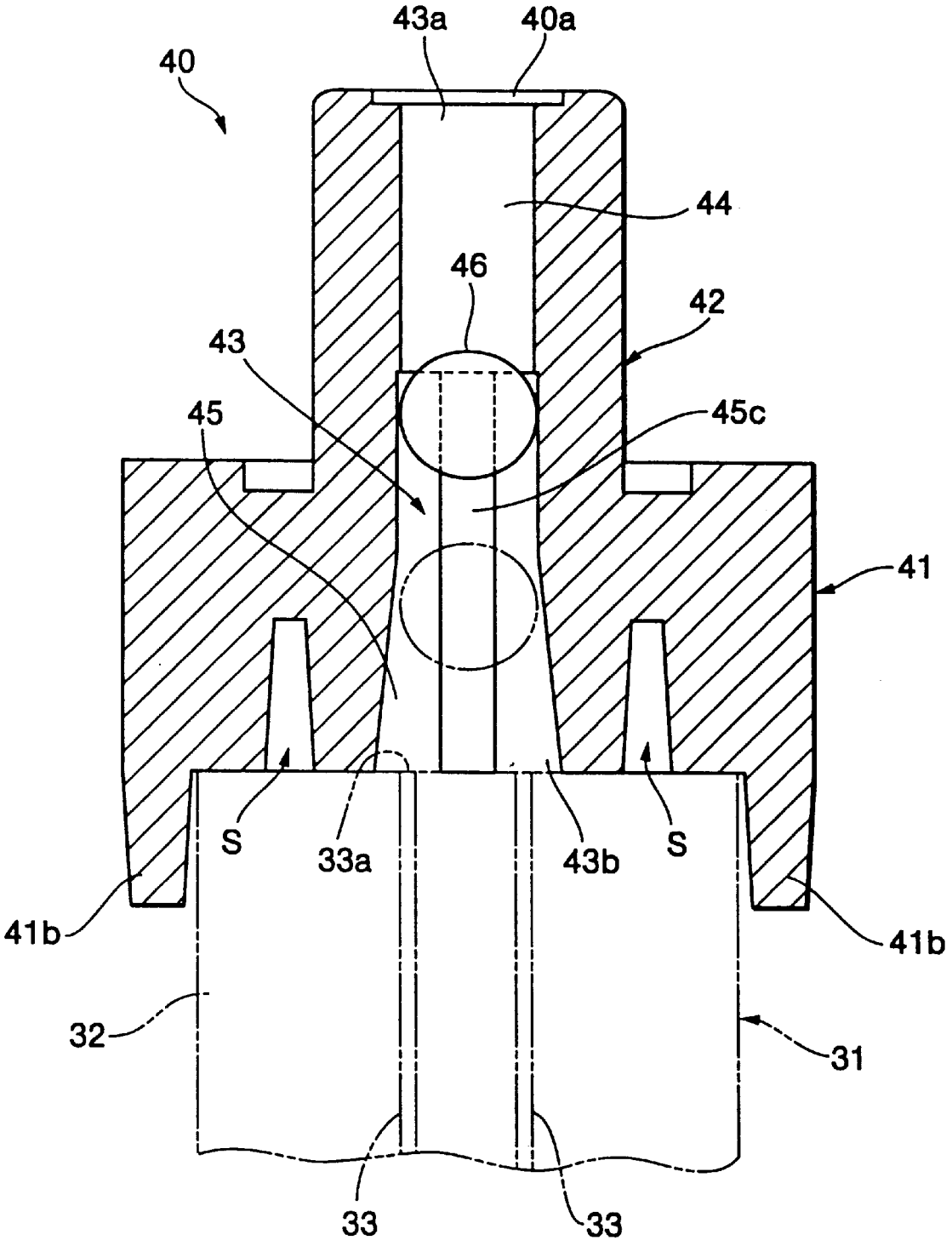
FIG. 7 is a cross-sectional view of the manifold taken along a line VII—VII of FIG. 4.
Figure 8:
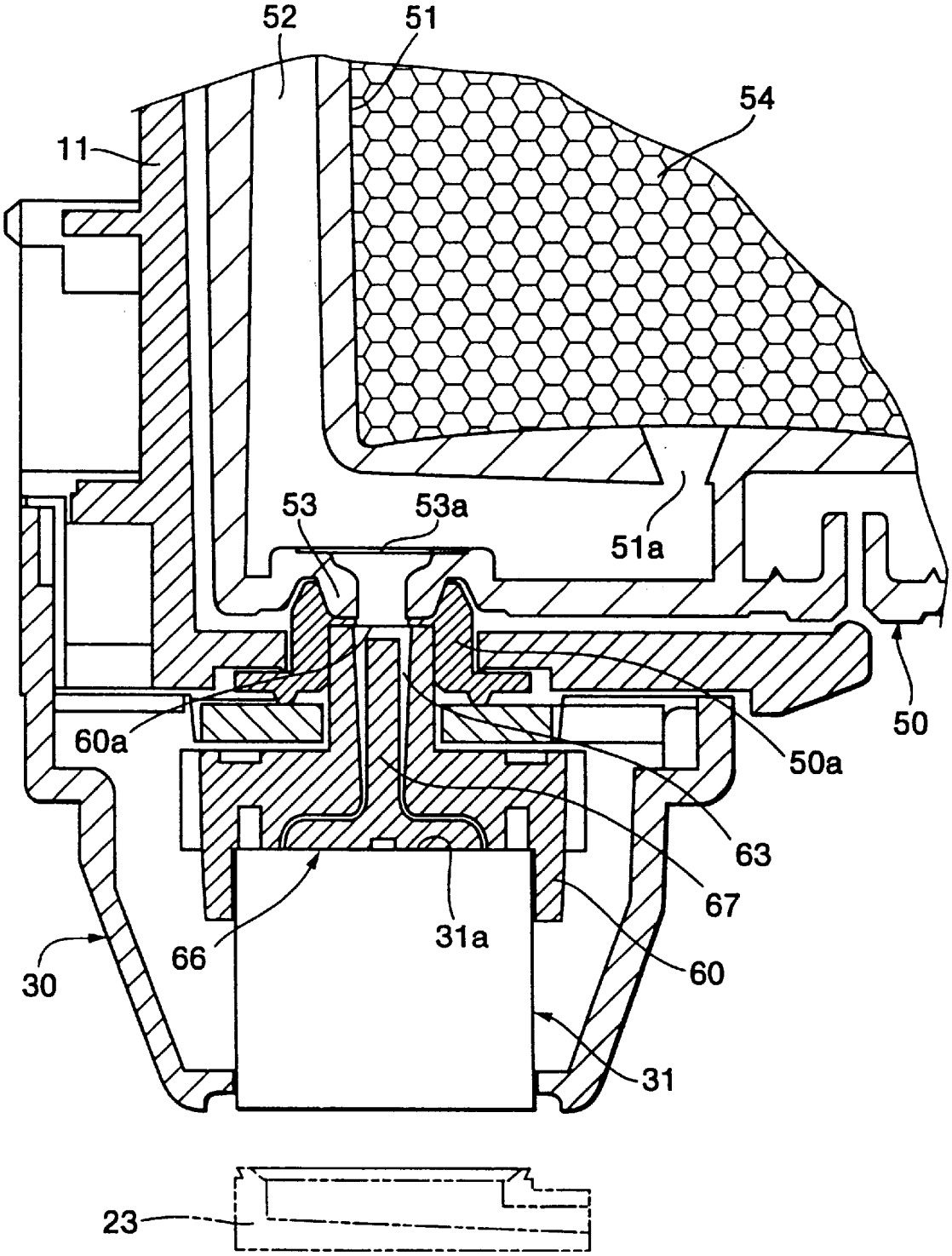
FIG. 8 is a cross-sectional view of an ink jet recording device according to a second embodiment of the present invention.

As shown in FIGS. 4 and 6, the main portion 42 has integral guide walls 45*c* that protrude toward the interior of the broad portion 45 between the rows of ejection channels 33. The guide walls 45*c* are connected to the ceiling surface of the broad portion 45, and extend to near the connection path 44. It should be noted that a portion of the first curved surface 45*a* serves as the ceiling surface. The guide walls 45*c* regulate movement path of the float 46 so that the float 46 moves only in the vertical direction in the center of the broad portion 45. Therefore, the float 46 will not move to an off-center position within the broad portion 45. Also, the guide walls 45*c* define separate ink channels 45*d* within the broad portion 45. The ink channels 45*d* fluidly connect the corresponding rows of ejection channels 33.

Next, the purging operations performed after exchange of the ink cartridge 50 will be described. The purging operations are performed for introducing fresh ink from a new ink cartridge 50 into the ink supply path 43 and the ejection channels 33 and also for discharging air bubbles out of the ink supply path 43 and the ejection channels 33.

When the ink suction unit 21 generates negative purging pressure in the ejection channels 33, fresh ink is introduced from the ink cartridge 50 into the ink supply path 43. The flow of ink pushes the float 46 down into the broad portion 45. Because the float 46 has a spherical shape that is symmetrical with respect to the connection path 44, ink can be smoothly introduced into the broad portion 45. Also, because the guide walls 45*c* regulate movement of the float 46 so it does not move into the off centered position, ink can be introduced into the broad portion 45 at a uniform manner without any imbalance, resulting in stabilizing the ability to discharge air bubbles and introduce ink.

The ink flow in the broad portion 45 follows the inner surface of the broad portion 45 between the float 46 and the inner surfaces as indicated by arrows F in FIG. 5. Because the presence of the float 46 increases the speed of the ink flow near the inner surfaces, the ink flow easily pulls away air bubbles that cling to the inner surfaces of the broad portion 45. At the same time, any air bubbles clinging to the float 46 are also removed. The air bubbles are then drawn into the ejection channels 33 and discharged.

Because the broad portion 45 has a broadened shape as described above, the ink flow reaches to the corner portions C while maintaining the rapid flow speed, and is guided to the ejection channels 33. Therefore, air bubbles trapped in the corner portions C are easily guided into the ejection channels 33. At the same time, ink can properly fill the entire ink supply path 43 without excluding the corner portions C. Accordingly, ability to discharge micro-bubbles trapped in the corner portions C is enhanced.

It should be noted that when the ink cartridge 50 is exchanged, a certain volume of air is introduced to a connection portion between the mesh filter 53*a* and the mesh filter 40*a*. The air is introduced into the ink supply path 43 during purging operations. However, as described above, fresh ink flows along the inner surface of the broad portion 45 toward the ejection channels 33 by the corner portion C. Therefore, air is not easily trapped in the corner portion C.

Further, because the presence of the guide walls 45*c* decreases the volume of the broad portion 45, the speed of ink flow increases overall, so that the ability to discharge air bubbles can be further enhanced.

Moreover, because the separate ink channels 45*d* are provided, the ability to discharge air bubbles and introduce ink to the corner portions C is enhanced.

Normally, suction force, that is, negative purging pressure, is large at the initial stage of purging operations and gradually decreases with time. Therefore, sometimes air bubbles cannot be drawn into the ejection channels 33 from a position that is separated somewhat from the ink inlet port 33*a*, such as the connection path 44.

However, because the float 46 floats upward and blocks the connection path 44 when the purging operations are completed, air bubbles, which have not been drawn into the ejection channels 33 from the connection path 44 during purging operations, will not reenter the connection path 44, but instead will remain in the broad portion 45. Accordingly, air can be reliably discharged in subsequent purging operations.

Because the second curved surface 45*b* is connected to the upper surface 31*a* of the ink jet head 31 by the wide incline, ink flows into the corner portions C almost straight downward, so that the amount of residual bubbles remaining at the corner portion C can be greatly reduced. Also, even if an air bubble remains in the corner portions C, the air bubble will easily float toward the connection path 44 by its buoyancy. Therefore, the air bubbles will not be easily drawn into the ejection channels 33 during printing operations. Also, even if the air bubble clings to the second curved surface 45*b* and grows to a large size, because the depth h is secured above the corner portion C, the grown air bubble takes a certain amount of time before reaching the ink inlet ports 33*a*. Accordingly, there is no need to frequently perform purging operations during the printing operations.

Next, a manifold 60 according to a second embodiment of the present invention will be described while referring to FIGS. 8 to 12. The manifold 60 of the present embodiment is used in the above described ink jet recording device 1.

Figure 9:
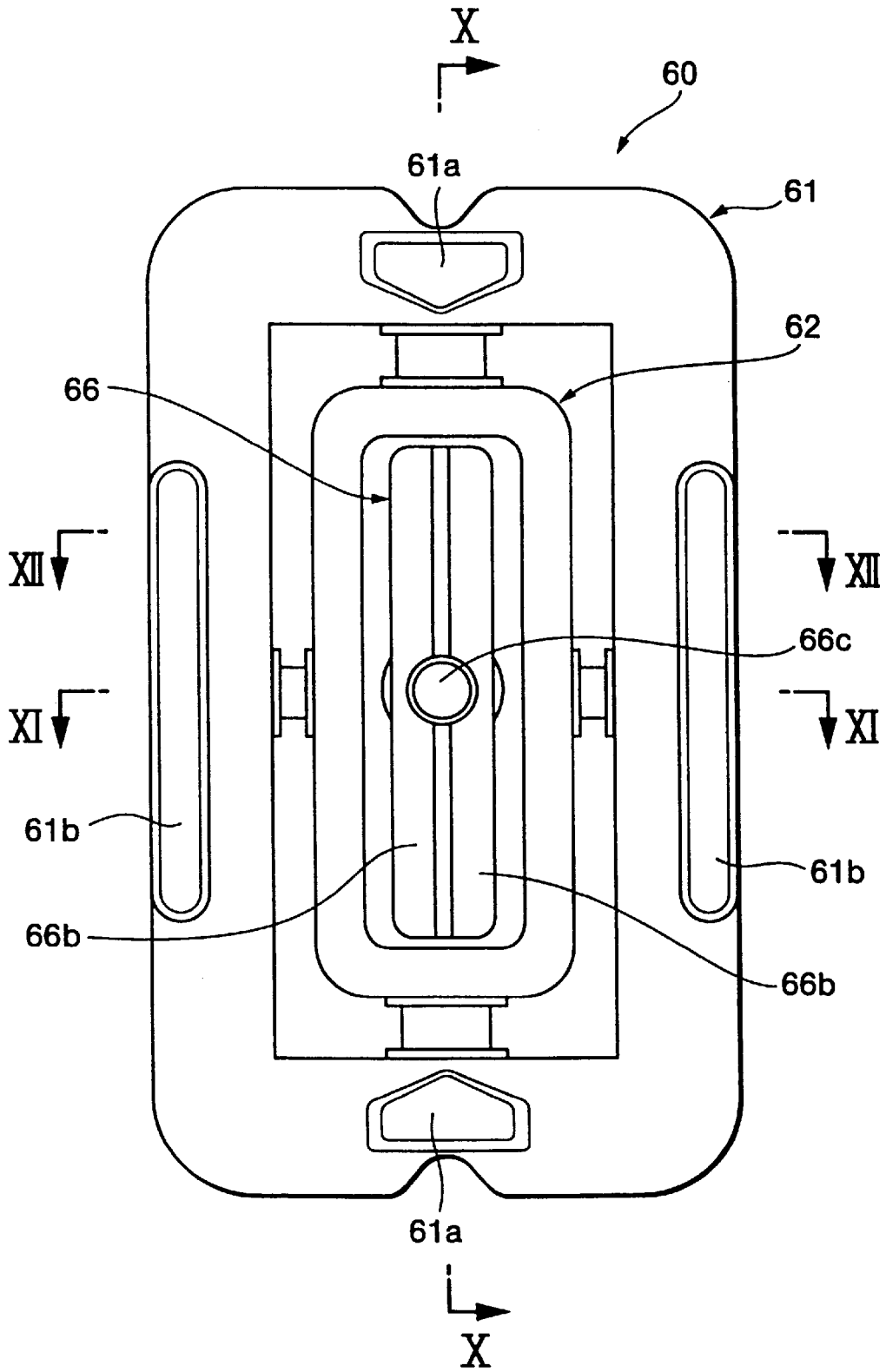
FIG. 9 is a plan view of a manifold of the ink jet recording device of FIG. 8.

The manifold 60 includes a frame 61 and a main portion 62. As shown in FIG. 9, a pair of fixing ribs 61*a* and a pair of positioning ribs 61*b* are connected to the frame 61. The fixing ribs 61*a* are fixed to the side surfaces of the ink jet head 31. The positioning ribs 61*b* are for positioning the manifold 60 on the ink jet head 31.

Figure 10:
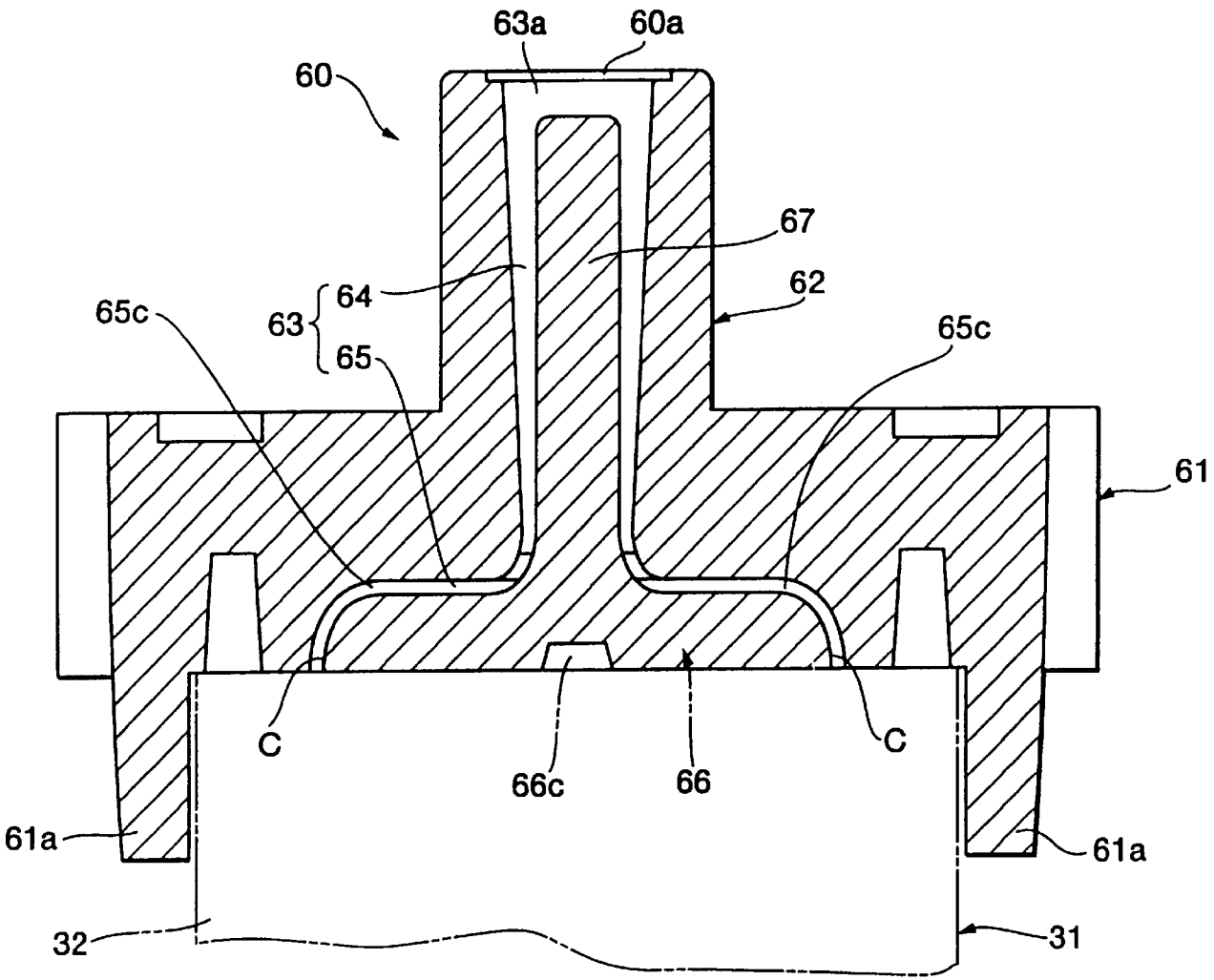
FIG. 10 is a cross-sectional view of the manifold taken along a line X—X of FIG. 9.

The main portion 62 is formed with an ink supply path 63. The ink supply path 63 includes a connection path 64 having a small diameter and broad portion 65. The connection path 64 is substantially centered between the rows of ejection channels 33, and is connected to the ink cartridge 50. A mesh 60*a* is provided at an ink inlet 63*a* of the connection path 64. As shown in FIGS. 5 and 10, the connection path 64 is formed longer than the connection path 44 of the manifold 40.

Figure 12:
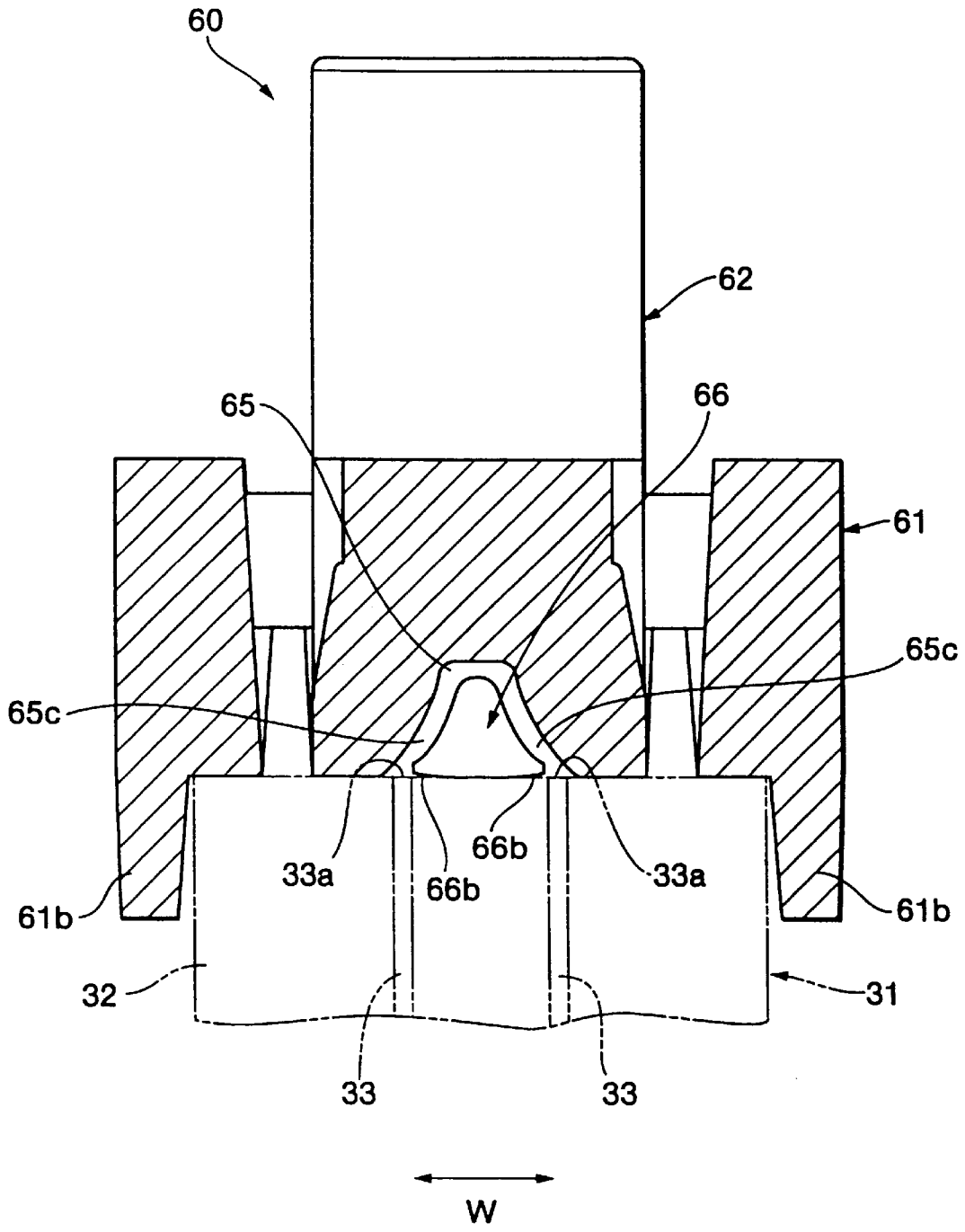
FIG. 12 is a cross-sectional view of the manifold taken along a line XII—XII of FIG. 9.

Also, the broad portion 65 has a different shape from the broad portion 45 of the manifold 40. Specifically, as shown in FIG. 10, the broad portion 65 symmetrically broadens in substantially horizontal direction from the connection path 64 toward the end of the rows of ejection channels 33, and has a curved shape that protrudes outward from the interior of the broad portion 65 near the ends of the rows of ejection channels 33. Also, as shown in FIG. 12, the broad portion 65 has a substantially truncated cross-sectional shape. That is, the inner surface of the broad portion 65 curves so as to protrude inward in the widthwise direction W. With this configuration, the broad portion 65 has a smaller volume than the broad portion 45 of the manifold 40.

Figure 11:
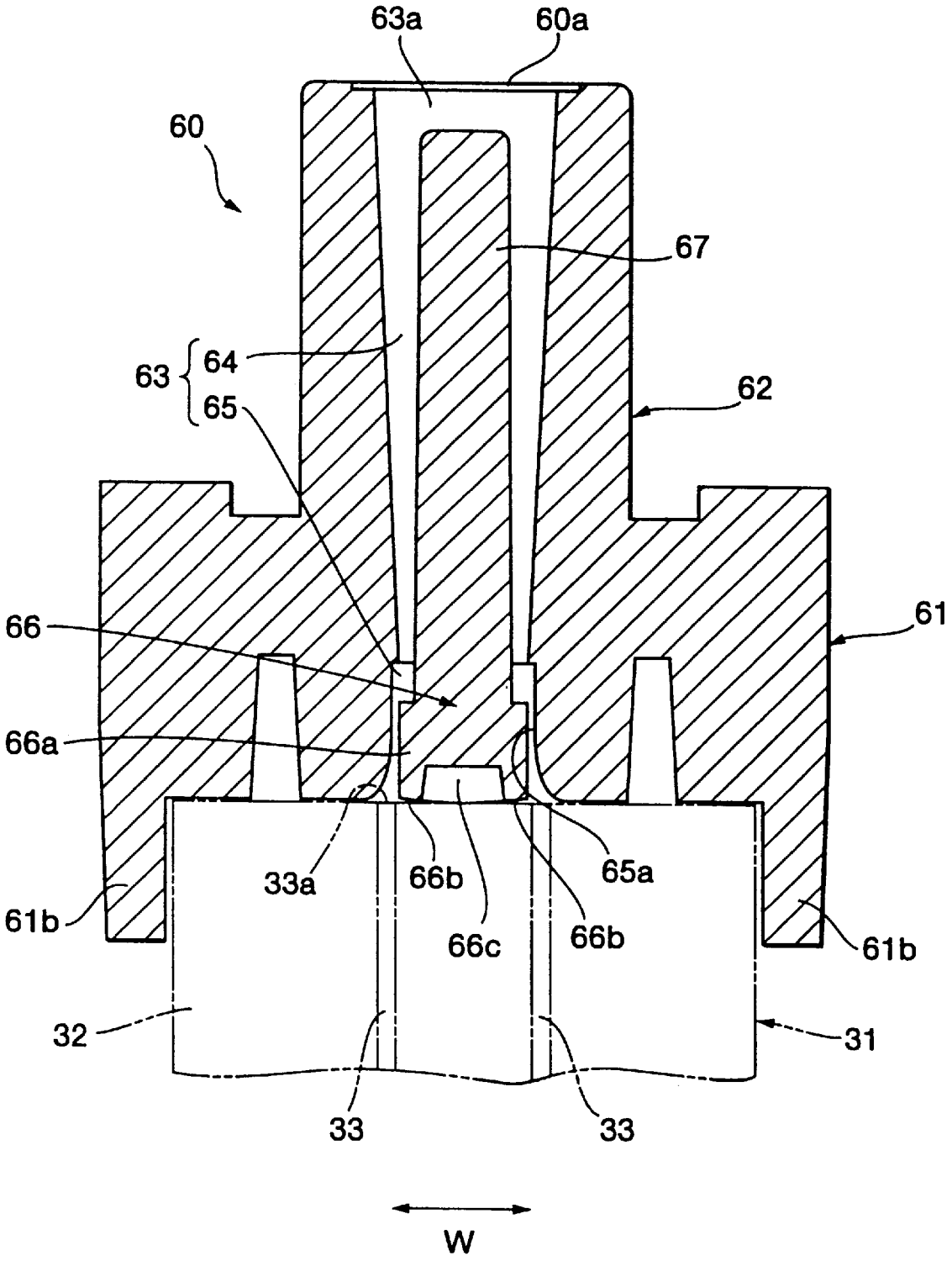
FIG. 11 is a cross-sectional view of the manifold taken along a line XI—XI of FIG. 9.

As shown in FIGS. 10 to 12, a spacer 66 is housed within the broad portion 65. The spacer 66 has substantially the same shape as the broad portion 65, but is slightly smaller than the broad portion 65. The spacer 66 has a specific gravity larger than the specific gravity of the ink. The spacer 66 defines narrow ink channels 65*c* between the spacer 66 and the inner surfaces of the broad portion 65. The ejection channels 65 are in fluid connection with the corresponding rows of ejection channels 33.

Figure 13:
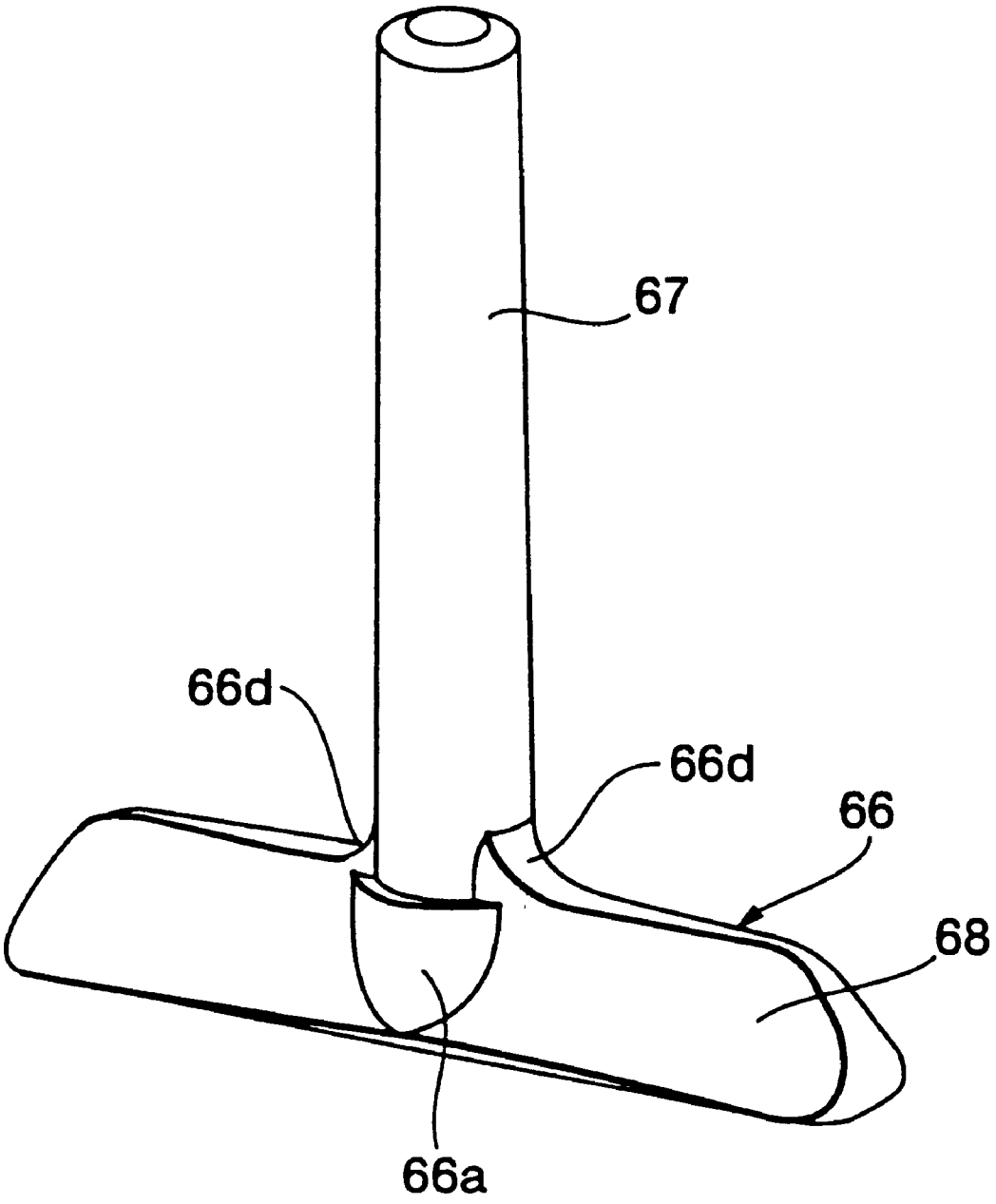
FIG. 13 is a perspective view of a spacer of the manifold of FIG. 9.

Specifically, as shown in FIGS. 11 to 13, the spacer 66 has a base portion 68, and a columnar portion 67 that protrudes in the vertical direction integrally from the center of the base portion 68. The columnar portion 67 is housed within connection path 64. The base portion 68 is formed with protrusions 66*a* at the center of its side surfaces. The protrusions 66*a* have a shape that slightly swells while curving. The protrusions 66*a* are positioned below upper sides 66*d* of the base portion 68. Also, as shown in FIGS. 10 and 11, a bottom surface of the spacer 66 is formed with taper surfaces 66*b* and an indentation portion 66*c*. The taper surfaces 66*b* slant slightly upward from the widthwise center of the spacer 66 toward the edges of the spacer 66. The indentation portion 66*c* is formed at the longitudinal center of the spacer 66.

As shown in FIG. 11, the broad portion 65 is formed with indented portions 65*a* which are slightly indented outward at positions corresponding to the protrusions 66*a*, while following the contours of the protrusions 66*a*. The spaces between the protrusions 66*a* and the indented portions 65*a* are set smaller than the spaces between the other portions of the spacer 66 and inner surfaces of the broad portion 65. With this configuration, even if the spacer 66 shifts position in the widthwise direction W, because the protrusion 66*a* contacts the indented portion 65*a*, the other portions of the spacer 66 will not contact the inner surface of the broad portion 65. That is to say, the outer surface of the spacer 66 and the inner surface of the broad portion 65 can be prevented from contacting each other at positions other than the protrusion 66*a* and the indented portion 65*a*. Therefore, the ink channels 65*c* will be maintained in fluid connection with the ejection channels 33 without being blocked off, and the ink can be reliably supplied to the ink inlet port 33*a*.

Also, even if the spacer 66 shifts to the position over the ink inlet port 33*a*, the spacer 66 will not interrupt supply of ink to the ejection channels 33 because a slight space is secured between the taper surface 66*b* of the spacer 66 and the upper surface 31*a* of the ink jet head 31. Ink can be reliably supplied through the slight space into the ink inlet port 33*a*.

The presence of the spacer 66 greatly decreases the volume of the ink supply path 63. However, because a fairly large volume is secured within the connection path 64, which is separated from the ink jet head 31, influence of cross talk will not be easily received. Further, air bubbles that have been trapped and grow large within the indentation portion 66*c* surpass the effects of cross-talk. It should be noted that, as best seen in FIG. 11, the indentation portion 66*c* is completely and constantly covered by the upper surface 31*a* of the ink jet head 31. Therefore, no bubbles will be drawn out from the indentation portion 66*c* into the ejection channels 33, and air bubbles in the indentation portion 66*c* will not be a source of defective the printing.

As described above, according to the second embodiment of the present invention, ink passes through the narrow ink channels 65*c* with a considerable speed along the inner surface of the ink supply path 63. Therefore, small air bubbles are almost completely swept off the inner surface of the ink supply path 63 by flow of ink during purging operations, and are reliably discharged with some ink.

Further, because ink is supplied uniformly to rows of ejection channels 33, including the corner portions C, by passing through the narrow ink channels 65*c*, ability to discharge air bubbles from the corner portions C is greatly improved.

While the invention has been described in detail with reference to specific embodiments thereof, it would be apparent to those skilled in the art that various changes and modifications may be made therein without departing from the spirit of the invention, the scope of which is defined by the attached claims.

For example, in the above-described second embodiment, the spacer 66 is merely inserted within the ink supply path 63. However, the spacer 66 can be fixedly adhered to a partially protruding sleeve formed on the ceiling surface of the ink supply path 63. Alternatively, the protrusion 66*a* can be formed with a dimension so as to pressingly fit to the indented portion 65*a*. In either case, a predetermined space should be secured between the bottom surface of the spacer 66 and the upper surface 31*a* of the ink jet head 31.

Also, the spacer 66 can be formed from a material with a specific gravity smaller than the specific gravity of ink so that the spacers 66 floats within the ink supply path 63. In this case, the upper sides 66*d* of the floating spacer 66 are held by the ceiling surface of the broad portion 65. The suction force generated during purging operations pulls the spacer 66 downward so as to introduce fresh ink into the broad portion 65. However, even if the spacer 66 cannot be drawn downward during the printing operations, ink can be introduced into the broad portion 65 by flowing above the protrusions 66*a* because the protrusions 66*a* are formed below the upper sides 66*d*.

The floating spacer 66 in the ink supply path 63 may tilt for some reasons. However, the columnar portion 67 within the connection path 64 operates to maintain the spacer 66 in the upright posture. Therefore, the tilt of the spacer 66 will be quickly corrected by the columnar portion 67, so that the ink supply path 63 will not be blocked by the spacer 66.

Although in the above-described first and second embodiments, ink jet head 31 is formed with two rows of ejection channels 33, the ink jet head 1 can be formed with three or more rows of ejection channels.

Further, in the above-described embodiments, purging operations are performed by the ink suction unit 21 by sucking ink from the ejection channels 33 of the ink jet head 31. However, purging operations can be performed by pushing fresh ink from the ink cartridge 50 into the ink jet head 31.

What is claimed is:

1. An ink jet recording device comprising:

an ink jet head that has a surface and is formed with a channel row including a plurality of ink ejection channels, the channel row having ends, the plurality of ink ejection channels having inlet ports opened at the surface;

a manifold that is formed with an ink supply path fluidly connecting the plurality of ink ejection channels with a cartridge that stores ink, the ink supply path including a first portion and a second portion, the second portion being defined by an inner surface, wherein the ink is supplied into the plurality of ink ejection channels form the cartridge through the first portion and the second portion; and a guide member that is accommodated within the second portion of the ink supply path, and guides the ink within the second portion to flow along the inner surface, wherein the guide member is a float having a specific gravity smaller than a specific pravity of the ink, the float being freely movable within the second portion.

2. The ink jet recording device according to claim 1, wherein the surface of the ink jet head faces upward in use, the second portion of the ink supply path encompasses the surface from above, the inner surface defining the second portion includes a ceiling surface that faces the surface, and wherein the guide member guides the ink to flow along the ceiling surface.

3. The ink jet recording device according to claim 2, wherein the first portion of the ink supply path is positioned above a center of the channel row, and the second portion substantially symmetrically broadens in a tapering manner from the first portion toward the ends of the channel row to encompass the inlet ports.

4. The ink jet recording device according to claim 1, further comprising a suction unit that generates a negative pressure within the ink supply path, wherein the ink jet head has an another surface opposite from the surface, the another surface being formed with a plurality of nozzles fluidly connecting to corresponding ones of the plurality of ink channels, and wherein the suction unit is detachably mounted onto the another surface and sucks the ink out of the ink supply path through the nozzles when generates the negative pressure.

5. The ink jet recording device according to claim 1, wherein the second portion of the ink supply path encompasses the inlet ports of the plurality of ink ejection channels from above, and the float is movable away from the surface of the ink jet head toward the first portion by its buoyancy to close off the first portion.

6. The ink jet recording device according to claim 5, wherein the manifold has a wall protruding inwardly of the second portion, the wall regulating a moving path of the float.

7. The ink jet recording device according to claim 5, wherein the ink jet head is formed with a plurality of channel rows extending parallel with one another, and the manifold has walls protruding inwardly of the second portion and between adjacent ones of the plurality of channel rows, the walls protruding from end sides of the plurality of channel rows, the walls regulating a moving path of the float.

8. The ink recording device according to claim 7, wherein the walls define separate ink paths fluidly connected to the plurality of ink channels.

9. The ink jet recording device according to claim 1, wherein the float has a spherical shape.

10. The ink jet recording device according to claim 1, wherein the float is formed with a column portion protruding vertically, the column portion being housed within the first portion.

11. The ink jet recording device according to claim 1, wherein the second portion is defined by an inner surface which extends substantially vertically at least at a portion adjacent to the surface of the ink jet head.

12. An ink jet recording device, comprising:

an ink jet head that has a surface and is formed with a channel row including a plurality of ink ejection channels, the channel row having ends, the plurality of ink ejection channels having inlet ports opened at the surface;

a manifold that is formed with an ink supply path fluidly connecting the plurality of ink ejection channels with a cartridge that stores ink the ink supply path including a first portion and a second portion, the second portion being defined by an inner surface, wherein the ink is supplied into the plurality of ink ejection channels form the cartridge through the first portion and the second portion; and a guide member that is accommodated within the second portion of the ink supply path, and guides the ink within the second portion to flow along the inner surface, wherein the guide member is inserted within the ink supply path and has the same outer contour shape as an inner contour shape of the ink supply path.

13. The ink jet recording device according to claim 12, wherein the guide member defines separate ink paths fluidly connected to the plurality of ink channels.

14. The ink jet recording device according to claim 12, wherein the guide member has a specific gravity greater that a specific gravity of the ink.

15. The ink jet recording device according to claim 14, wherein the ink jet head is formed with a pair of channel rows extending parallel with each other, and the guide member is positioned between the pair of channel rows.

16. The ink jet recording device according to claim 15, wherein the each of the pair of channel rows extending in a first direction, the guide member has a bottom surface which slants slightly upward from a center in a second direction perpendicular to the first direction toward edges of the guide member.

17. The ink jet recording device according to claim 16, wherein the second portion has a substantially truncated cross-sectional shape.

* * * * *